United States Patent [19]

Dabney

[11] Patent Number: 4,739,977

[45] Date of Patent: Apr. 26, 1988

[54] BOX SPRING ASSEMBLY

[75] Inventor: Upton R. Dabney, Georgetown, Ky.

[73] Assignee: Hoover Universal, Inc., Ann Arbor, Mich.

[21] Appl. No.: 45,071

[22] Filed: May 1, 1987

[51] Int. Cl.[4] ..... F16F 3/00; A47C 23/04

[52] U.S. Cl. ..... 267/103; 5/247; 5/255; 5/276

[58] Field of Search ..... 267/103, 104, 105, 106, 267/107, 108, 109; 5/247, 255, 248, 256, 272, 273, 276

[56] References Cited

U.S. PATENT DOCUMENTS

| | | | |
|---|---|---|---|
| 3,990,121 | 11/1976 | Whitaker | 267/107 |
| 4,339,834 | 7/1982 | Mizelle | 267/103 |
| 4,470,584 | 9/1984 | Mizelle | 267/103 |
| 4,475,724 | 10/1984 | Hancock | 267/106 |
| 4,684,111 | 8/1987 | Hagemeister | 267/103 |

FOREIGN PATENT DOCUMENTS

| | | | |
|---|---|---|---|
| 427118 | 4/1935 | United Kingdom | 5/256 |

*Primary Examiner*—Andres Kashnikow
*Assistant Examiner*—Mark Le
*Attorney, Agent, or Firm*—Harness, Dickey & Pierce

[57] ABSTRACT

An improved spring unit for a box spring assembly in which a grid assembly is supported above a frame by a plurality of such spring units. The spring units provide self-limited deflection to prevent them from taking a permanent set after being overloaded. Each unit has two separate legs which support the spring assembly grid assembly to reduce point loadings on the grid assembly. The top portion of the spring spreads out forces over a large area on the grid to further reduce point loading. The configuration of the spring units enables them to be stacked densely without interlacing or twisting. The spring units include a center base bar, a pair of torsion bars extending perpendicularly therefrom, a center torsion bar which is connected to the upper and lower portions of the spring by connecting bars, and a top portion having a torsion bar and a pair of bar members extending in the same horizontal plane.

13 Claims, 2 Drawing Sheets

BOX SPRING ASSEMBLY

BACKGROUND AND SUMMARY OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; and 4,470,584. Box spring assemblies of the general type shown in the above list of patents, all of which are owned by the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

Some current box spring assemblies typically have a wire grid assembly which is supported by an array of spring units attached to a supporting frame. One approach toward reducing costs of the box spring assembly is to minimize the gauge of the wires making up the grid assembly. Grid assembly wire diameter, however, is dependent upon the characteristics of the spring units on which the grid is supported. Some spring unit types do not distribute their loads on the grid assembly but instead exert undesirable localized or "point" loads which tend to permanently deform portions of the grid assembly when it is subjected to bedding loads. For assemblies employing such spring unit types, heavy gauge wire is necessary in the grid assembly to resist deformation.

Accordingly, it is desirable to provide an improved spring module or unit which reduces localized loading on the grid assembly. As a means of simplifying fabrication, it is further desirable to provide a spring module which can be conveniently attached to both the box spring frame structure and the grid assembly. Since box spring assemblies may be subjected to overload conditions, the spring units should further be capable of withstanding such loading without sustaining permanent damage or taking a set. Therefore, the springs of a box spring assembly must include means for preventing deflection beyond elastic limit. Since large numbers of spring modules must be handled and packaged, it is further preferable for them to be stackable in a compact manner without interlacing or twisting.

In accordance with the present invention, an improved box spring assembly is provided having spring modules which achieve the above-mentioned desirable features. Additional benefits and advantages of the present invention will become apparent to those skilled in the art to which this invention relates from the subsequent description of the preferred embodiment and the appended claims taken in conjunction with the accompanying drawings.

DETAILED DESCRIPTION OF THE INVENTION

Figure 1:
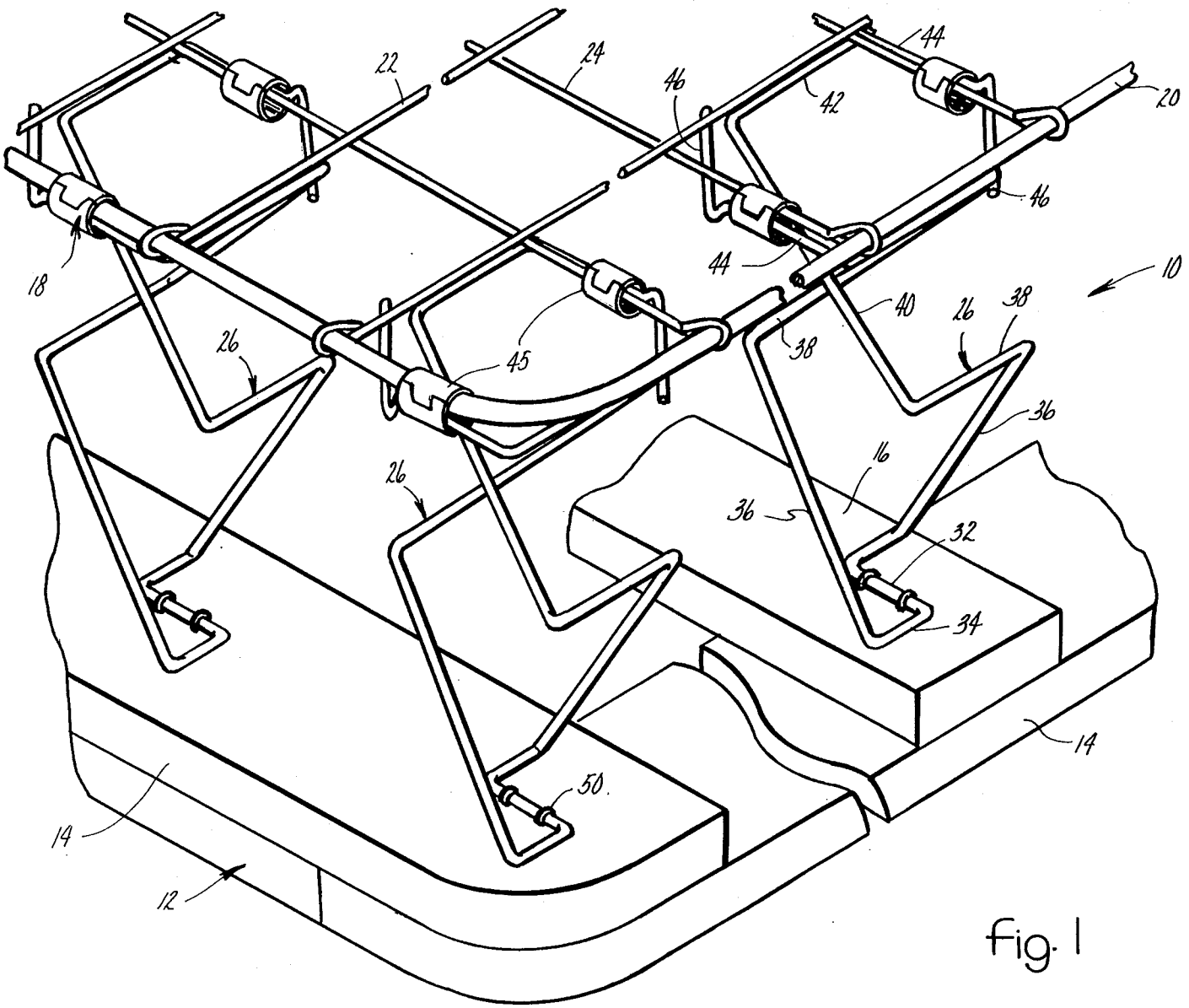
FIG. 1 is a pictorial view of a box spring assembly incorporating the improved spring units of this invention.

A box spring assembly in accordance with this invention is shown in FIG. 1 and is generally designated by reference number 10. FIG. 1 is a cut-away view showing a small portion of box spring assembly 10 and is representative of the entire structure which is a repetition of the elements shown in the figure. Assembly 10 includes a lower frame or base structure 12 conventionally made of interconnected wood members which provides a foundation for the remaining components. The frame 12 includes side rails 14, which are shown interconnected to form an outside corner, and further includes several cross rails 16 which extend laterally across the frame 12 and are fastened to side rails 14.

Grid assembly 18 is positioned above the frame 12 and has a perimeter outline shape which corresponds to that of the frame 12. Grid asssembly 18 includes a heavy gauge border wire 20 outlining its perimeter with a number of long wires 22 extending between the ends of assembly 18, and a number of cross wires 24 extending between the sides of the assembly and intersecting the long wires to define a wire grid. Cross wires 24 and long wires 22 are usually welded at their junctions and these wires are wound at their ends about the border wire 20 as shown in FIG. 1.

Figure 2:
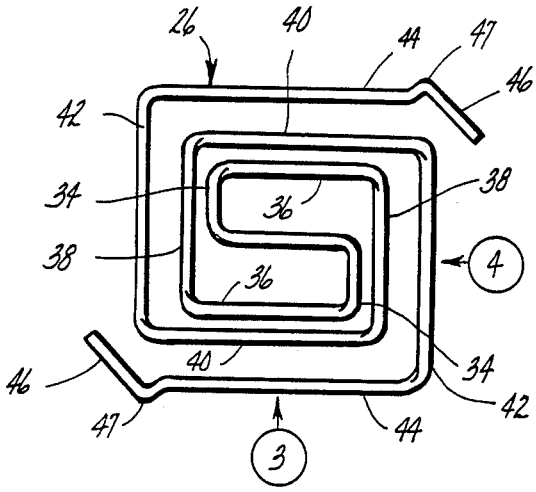
FIG. 2 is a top view of the spring units shown in FIG. 1.
Figure 3:
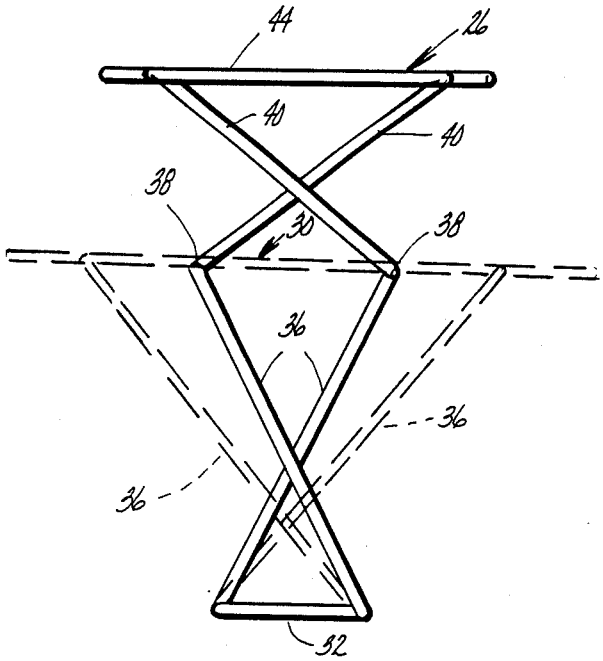
FIG. 3 is a side view taken in the direction of arrow 3 of FIG. 2.
Figure 4:
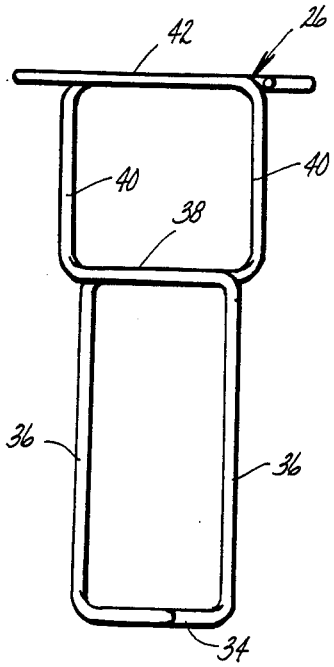
FIG. 4 is another side view but taken in the direction of arrow 4 of FIG. 2.

A number of identical spring modules or units 26 are provided which are positioned between the frame 12 and the grid assembly 18. Details of the configuration of spring units 26 are best described with reference to FIGS. 2 through 4. Each of the spring units 26 is made from a single piece of wire and is comprised generally of a bottom portion 28, a top portion 30, and a center portion 31. Bottom portion 28 includes base bar 32 formed from the center of the wire piece, and base torsion bars 34.

When spring unit 26 is mounted, base bar 32 extends horizontally and is supported by the frame 12. Base torsion bars 34 extend perpendicularly from the ends of base bar 32, and lie within the same plane as the base bar. Center portion 31 of spring unit 26 includes connecting bars 36 and 40, and center torsion bar 38. Connecting bars 36 extend upwardly from base torsion bars 34 and are oriented in a crossing fashion as viewed in FIG. 3.

Center torsion bars 38 extend horizontally from connecting bars 36, and connecting bars 40 extend upwardly to connect center torsion bars 38 with top portion 30. Connecting bars 40, like bars 36, form a crossing pattern as viewed in FIG. 3. Spring unit top portion 30 includes upper torsion bars 42, attaching bars 44, and end bars 46, all of which lie in the same horizontal plane.

As shown in FIG. 1, each of the spring units 26 is mounted on the frame 12 by staples 50 which engage base bar 32. Spring unit top portion 30 is connected to grid assembly 18 by conventional metal clips 45 or other fasteners engaging attaching bar 44 and cross wires 24 (or long wires 22). Top portion 30 of spring unit 26 preferably defines a rectangular outline which is complementary in shape to the outlines formed by the intersections of long wires 22 and cross wires 24. Due to this configuration, upper torsion bars 42 and attaching bars 44 may be located in registry with the wires 22 and 24 such that the forces exerted by spring units 26 on grid assembly 18 are distributed, this avoiding localized loading on the grid assembly. Moreover, end bars 46 extend at an obtuse angle from attaching bars 44 and further tend to distribute loads by acting on both wires 22 and 24. Outwardly facing notches or protrusions 47 formed at the junctures of bars 44 and 46 insure that the bars 42 and 44 will form a support platform for the grid which is effective even if the bars shift slightly during use. By distributing loading on grid assembly 18, spring units 26 enable the gauge of wires making up grid assembly 18 to be reduced without sacrificing resistance to permanent deformation of the grid assembly.

When spring units 26 are compressed by a load acting downwardly on them, torsion bars 34, 38 and 42 are twisted such that they store energy and provide resilience. A range of compression of spring unit 26 is provided until it reaches the deflected position shown in phantom lines in FIG. 3. In this position, center torsion bars 38 fall within the plane of spring top portion 30 such that spring unit 26 "bottoms out" and continued deflection of the torsion bar elements is resisted. This feature prevents excessive stress on the torsion bar elements so that they are permitted to deflect only in their range of elastic deformation. Once the spring units 26 reach the deflected position shown in FIG. 3, the spring is capable of withstanding very high column loads before failure.

Spring unit 26 according to the present invention has an "open top" configuration in that the ends of the wire making up the spring unit are within top portion 30. Due to this configuration, the spring unit 26 behaves like a pair of individual spring elements which are joined at base bar 32. Such independent support enables spring unit 26 to be self-adjusting in nature and capable of responding to contour loading. This feature, coupled with the rectangular configuration of the top portion 30 of spring unit 26, serve to distribute loadings on grid assembly 18, thereby reducing undesirable localized loading.

Spring units 26 further provide the advantage that the positioning and orientation of bars 32 and 34 allows clear access for stapling guns, thus facilitating attachment of the spring units to the frame 12. Another advantage of spring unit 26 is its "stackability". As is particularly evident from FIG. 2, the cross-sectional area swept out by the various portions of spring unit 26 increases progressively from bottom to top and provides an unobstructed inside cavity outlined by the spring elements. This configuration allows a number of spring units 26 to be stacked together in a dense form without interlacing or twisting, thus providing for efficient packaging and shipping.

While the above description constitutes the preferred embodiments of the present invention, it will be appreciated that the invention is susceptible to modification, variation and change without departing from the proper scope and fair meaning of the accompanying claims.

What is claimed is:

1. A spring unit for a box spring assembly of the type having a supporting frame with a grid assembly supported above said frame by an array of spring units, at least one of said spring units comprising:

a bottom portion having a base bar and a pair of base torsion bars extending from said base bar in a generally perpendicular direction therefrom and lying substantially within the same plane as said base bar, a top portion having a pair of upper torsion bars, and a pair of attaching bars extending perpendicularly from said torsion bars and lying within the same plane thereof, and a center portion having a pair of center torsion bars and a pair of first connecting bars extending from each of said center torsion bars to said base torsion bars and a pair of second connecting bars extending from each of said center torsion bars to said upper torsion bars.

2. The spring unit for a box spring assembly according to claim 1 further comprising a pair of end bars connecting to said attaching bars and extending at an obtuse angle therefrom.

3. The spring unit for a box spring assembly according to claim 1 wherein said spring unit is formed from a single piece of wire stock and wherein the ends of said wire stock are within said top portion.

4. The spring unit for a box assembly according to claim 1 wherein the cross sectional areas swept out by said spring unit portions increases progressively from said bottom portion to said center portion to said top portion and wherein said spring outlines an unobstructed inside cavity, whereby a plurality of said spring units may be stacked together.

5. A spring unit for a box spring assembly according to claim 1 wherein said first connecting bars are oriented such that planes defined by said first connecting bars and said center torsion bars intersected at a line between said base torsion bars and said center torsion bars, and said second connecting bars oriented such that planes defined by said second connecting bars and said center torsion bars intersected at a line between said upper torsion bars and said center torsion bars.

6. A spring unit for a box spring assembly of the type having a frame with a grid assembly supported above said frame by an array of spring units, said spring units being formed from a single piece of wire stock with a pair of ends and a mid-point equidistant from said ends, said spring unit comprising:

a bottom portion formed from a segment of said wire stock containing said mid-point and having a base bar and a pair of base torsion bars extending from said base bar in a generally perpendicular direction therefrom and lying substantially within the same plane as said base bar, a top portion having a pair of upper torsion bars, and a pair of attaching bars extending perpendicularly from said torsion bars and lying within the same plane thereof, said wire stock ends lying within said top portion, and a center portion having a pair of center torsion bars extending within a plane parallel to the planes containing said base torsion bars and said upper torsion bars, and a pair of first connecting bars extending from said center torsion bars to said base torsion bars and a pair of second connecting bars extending from each of said center torsion bars to said upper torsion bars.

7. A spring unit for a box spring assembly according to claim 6 wherein said first connecting bars are oriented such that planes defined by said first connecting bars and said center torsion bars intersected at a line between said base torsion bars and said center torsion bars, and said second connecting bars oriented such that planes defined by said second connecting bars and said center torsion bars intersected at a line between said upper torsion bars and said center torsion bars.

8. A spring unit for a box spring assembly according to claim 6 wherein the cross sectional areas swept out by said spring portions progressively increase from said bottom portion to said center portion to said top portion and wherein said spring outlines an unobstructed inside cavity whereby a plurality of said spring units may be stacked together.

9. The spring unit for a box spring assembly according to claim 6 further comprising a pair of end bars connecting to said attaching bars and defining said ends of said wire stock.

10. A box spring assembly comprising:

a supporting frame, a grid assembly having a plurality of wires defining rectangular grid sections, and an array of spring units supporting said grid assembly above said supporting frame including;

a bottom portion having a base bar and a pair of base torsion bars extending from said base bar in a generally perpendicular direction therefrom and lying substantially within the same plane as said base bar, a top portion having a pair of upper torsion bars, and a pair of attaching bars extending perpendicularly from said torsion bars and lying within the same plane thereof, said upper torsion bars and said attaching bars outlining a rectangle which is substantially identical in shape to said rectangular grid sections of said grid assembly, and a center portion having a pair of center torsion bars and a pair of first connecting bars extending from each of said center torsion bars to said base torsion bars and a pair of second connecting bars extending from each of said center torsion bars to said upper torsion bars.

11. The spring unit for a box spring assembly according to claim 10 further comprising a pair of end bars connecting to said attaching bars and defining the ends of said wire stock.

12. The spring unit for a box spring assembly according to claim 10 wherein said spring unit is formed from a single piece of wire stock and wherein the ends of said wire are within said top portion.

13. The spring unit for a box spring assembly according to claim 10 wherein the cross sectional areas swept out by said spring unit portions increases progressively from said bottom portion to said center portion to said top portion and wherein said spring outlines an unobstructed inside cavity whereby a plurality of said spring units may be stacked together.

* * * * *